United States Patent [19]

Schubert

[11] Patent Number: 4,535,692

[45] Date of Patent: Aug. 20, 1985

[54] APPARATUS FOR SUPPLYING LIQUID MEDIUMS TO ROLLERS OF PRINTING MACHINES UTILIZING A DISTRIBUTOR PLATE

[75] Inventor: Johannes Schubert, Mainhausen, Fed. Rep. of Germany

[73] Assignee: M.A.N.-Roland Druckmaschinen Aktiengesellschaft, Fed. Rep. of Germany

[21] Appl. No.: 572,583

[22] Filed: Jan. 20, 1984

[30] Foreign Application Priority Data

Jan. 21, 1983 [DE] Fed. Rep. of Germany ..... 3301909

[51] Int. Cl.[3] ..... B41F 31/00

[52] U.S. Cl. ..... 101/337; 101/216; 101/352

[58] Field of Search ..... 101/132.5, 147, 161, 101/164, 165, 202, 203, 204, 293, 302, 307, 311, 319, 325, 335, 337, 338, 340, 341, 342, 348, 352, 353, 354, 362, 366, 216

[56] References Cited

U.S. PATENT DOCUMENTS

| | | | |
|---|---|---|---|
| 18,795 | 12/1857 | Moody | 101/319 |
| 18,947 | 12/1857 | Barrett | 101/341 |
| 20,217 | 5/1858 | Pettee | 101/319 |
| 20,556 | 6/1858 | Haskins | 101/319 |
| 651,397 | 6/1900 | Studebacker | 101/335 |
| 745,668 | 12/1903 | Richardson | 101/365 |
| 956,083 | 4/1910 | Harland | 101/365 |
| 1,137,400 | 4/1915 | Green | 101/132 |
| 1,696,770 | 12/1928 | Lang | 101/344 |
| 1,717,737 | 6/1929 | Schlesinger | 101/350 |
| 3,150,589 | 9/1964 | Senogles | 101/349 X |

FOREIGN PATENT DOCUMENTS

| | | | |
|---|---|---|---|
| 1954316 | 5/1971 | Fed. Rep. of Germany . | |
| 476256 | 7/1915 | France . | |
| 475669 | 11/1937 | United Kingdom | 101/340 |

*Primary Examiner*—Clyde I. Coughenour
*Assistant Examiner*—William L. Klima
*Attorney, Agent, or Firm*—Leydig, Voit, Osann, Mayer & Holt, Ltd.

[57] ABSTRACT

A method and apparatus for supplying a liquid medium, such as viscous printing ink, to the distributor and transfer rollers of printing machines. The apparatus includes an arcuate shaped distributor plate, an ink feed for dispensing a controlled quantity of liquid medium onto the distributor plate, and a feed roller that is mounted for cyclic movement in a path whereby it is rolled on the distributor plate to mix and uniformly spread the medium along the plate and about the periphery of the feed roller and then is moved into contact with the machine distributor roller to transfer the liquid medium thereto in a controlled manner. In one embodiment, the feed roller is moved in a cyclic circular path so that it first engages the distributor plate and then the distributor roller, and in another embodiment is moved in a reciprocating manner back and forth on the distributor plate and then engages the distributor roller. The ink feed is adapted to dispense controlled quantities of the liquid medium onto the distributor plate in timed relation with the cyclic feed roller movement.

12 Claims, 7 Drawing Figures

APPARATUS FOR SUPPLYING LIQUID MEDIUMS TO ROLLERS OF PRINTING MACHINES UTILIZING A DISTRIBUTOR PLATE

DESCRIPTION OF THE INVENTION

The present invention relates to a method and apparatus for feeding liquid mediums, and more particularly viscous printing inks, to rollers of sheet and reel fed machines.

It is known that high quality offset printing can be obtained only if the ink and water supply are accurately adjusted and monitored to provide a substantially constant feed. Similar conditions are required for quality continuous printing. To achieve and maintain a uniform color density on repetative printed sheets, in either case, means must be provided for quickly adjusting the relative proportions of ink and water. If, for example, the ink and water balance required in continuous printing for a specfic print is not maintained, there may be ink, and hence printing quality variations, outside permissable tolerances, particularly in multi-color and wet-in-wet printing. Consequently, it can be difficult to achieve uniform reproducability, particularly if minimum ink feed is required.

It is precisely in such cases that inertial effects of conventional ink supply systems can cause significant ink feed variations, and resulting spoiled prints. In an effort to accelerate adjustment of ink feeds, it is known to provide zone-wise adjustment of the ink feed by means of duck blades, ink regulators, and adjustment cylinders. It has been difficult, however, to adjust the duck roller and the gap-forming element, ink regulator, or adjusting cyclinder to a minimum ink feed condition, particularly when a zero ink supply condition is required. In such case the duck blade commonly goes into dry contact with the duck roller and experiences significant wear. While a correctly adjusted ink regulator desirably has no contact with the duck roller, in some cases the minimum quantity of ink passing between the edge of the regulator and the duck roller may still be excessive. Moreover, considerable time generally is required for adjusting such ink regulators, and this also has detracted from the quality of printing when precision adjustments are quickly required. Entrained paper dust and small dry particles of ink also can have a marked effect at the narrow ink metering gap of such devices and can similarly adversely affect the ink supply.

In an effort to reduce spoilage resulting from the foregoing ink supply systems, others have proposed dispensing or metering ink by means of ink supply nozzles or the like. German Offenlegungsschirft No. 1 954 316 discloses such a method and apparatus for feeding and metering ink to rollers in printing machines. Such system, however, still utilizes duck blades in connection with the ink metering, and thus, would have certain of the problems referred to above. Similarly, it is known that irregularities in ink supply occur when pumping ink to high speed rollers.

It is an object of the present invention to provide a method and apparatus for dispensing liquid mediums such as printing ink with improved control and uniformity, even under minimum ink feed conditions.

An object to provide an ink supply method and apparatus as characterized above which enables minimum quantities of ink to be dispensed with uniformity for repetitious printing work.

A further object is to provide a method and apparatus as characterized above in which the ink supply may be monitored for optimum uniformity, without thermal and wear-dependant variations.

Other objects and advantages of the invention will become apparent upon reading the following detailed description and upon reference to the drawings, in which.

Figure 1:
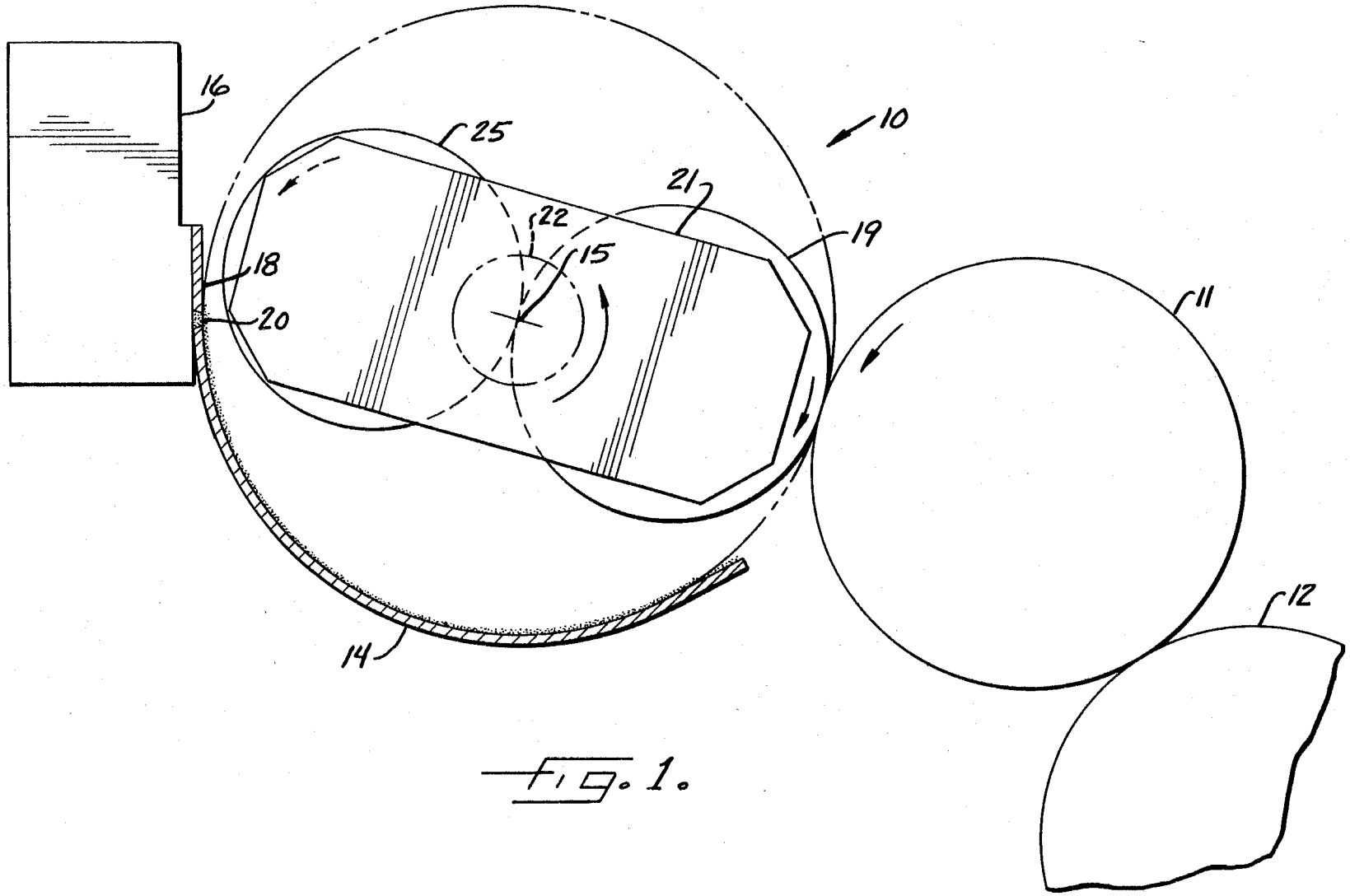
FIG. 1 is a vertical section of an illustrated ink supply system embodying the present invention.

While the invention is susceptible of various modifications and alternative constructions, certain preferred embodiments have been shown in the drawings and will be described below in detail. It should be understood, however, that there is no intention to limit the invention to the specific forms described but, on the contrary, the intention is to cover all modifications, alternative constructions and equivalents falling within the scope of the invention.

Referring now to FIG. 1 of the drawings, there is shown an illustrative ink supply apparatus 10 embodying the present invention supplying a liquid medium, such as a viscous printing ink, to a distributor roller 11, which in turn is in operative engagement with and supplies the medium to a transfer roller 12. The transfer roller 12 and distributor roller 11 may be a part of a known type of printing machine or the like. In such case, the transfer roller 12 is in operative engagement with another roller, or the like, to which the medium is transferred for use in operation of the machine. It will be understood that while the illustrated embodiment will be described in connection with the transfer of printing inks, it is equally applicatable to the supply and transfer of other liquid mediums.

In accordance with the invention, the ink supply apparatus includes a distributor plate that receives selectively controlled, relatively small quantities of liquid medium, and a feed roller adapted for movement over the distributor plate for thoroughly mixing and applying the medium in a uniform manner over the distributor plate and for transferring the medium in a controlled manner to a distributor roller. In the embodiment illustrated in FIG. 1, the ink supply apparatus 10 includes an arcute shaped distributor plate 14 having a radius of curvature about a center point 15, an ink feed 16 disposed at one end of the distributor plate 14 for supplying ink to the inside curved surface 18 of the plate 14, and a feed roller 19, preferably having a rubber outer periphery,mounted for cyclic movement along the inside distributor plate surface 18 from the ink feed end of the distributor plate 14 to the opposite end thereof and into engagement with the distributor roller 11. The distributor plate 14 in this case has a length of at least one-third the circumference of the circle defined by its radius of curvature. The ink feed 16 is disposed adjacent the outer side of the plate 14 and is adapted to dispense selectively controlled quantities of the liquid medium through an aperture or apertures 20 in the distributor plate 14.

For supporting and moving the feed roller 19, the feed roller is rotatably supported between opposed sides of a guide 21 at one end thereof for free relative rotational movement. The guide-21 in turn is mounted on a rotary shaft 22 having an axis coaxial with the axis 15 of curvature of the distributor plate 14. The shaft 22 may be rotated in a counter-clockwise direction, as viewed in FIG. 1, by an appropriate drive to move the feed roller 19 in a circular path with the outer perimeter thereof cyclically moving first into engagement with and along the distributor plate surface 18 and then into contact with the distributor roller.

In order to facilitate the uniform spreading and transfer of ink, a free rotating smoother roller 25 is rotatably disposed at the opposite end of the guide 21 with the peripherial surface thereof contacting the peripherial surface of the feed roller 19. The smoothing roller 25 preferably is slightly smaller in diameter than the feed roller 19 such that while the peripheral surface thereof engages the feed roller 19, it does not engage the distributor plate surface 18 during cyclic movement along the distributor plate. It will be seen that during each passage of the feed roller 19 along the distributor plate 14 it is caused to rotate relative to the guide, and this in turn rotates the smoothing roller 25 so that ink is spread uniformly about the feed roller and along the distributor plate.

Hence, upon each revolution of the guide 21, the feed roller 19 is rolled along the length of the distributor plate 14 so as to receive ink introduced through the distributor plate aperture 20 and mix and uniformly spread the ink along the length of the distributor plate and about the periphery of the feed roller so that the ink may be transferred in a substantially uniform manner onto the distributor roller 11 upon engagement therewith. It will be understood that rotational movement of the guide 21 may be appropriately controlled so as to either be continuously cycled, or intermitently cycled with the guide holding the feed roller 19 in engagement with the distributor roller for a predetermined period during each cycle. In the later case, the amount of ink transferred to the distributor roller 11 can be controlled by the hold time and the smoothing roller 25 serves to replenish ink on the feed roller 19 as the feed roller is in moving contact with the distributor roller 11. If on the other hand, the guide is continuously rotated, the amount of ink transferred to the distributor roller 11 can be varied by varying the rotary speed of the guide 21. In either case, it will be seen that a supply of ink from the ink feed 16 to the distributor roller 11 is substantially direct, and hence can be quickly effected or adjusted.

Figure 2:
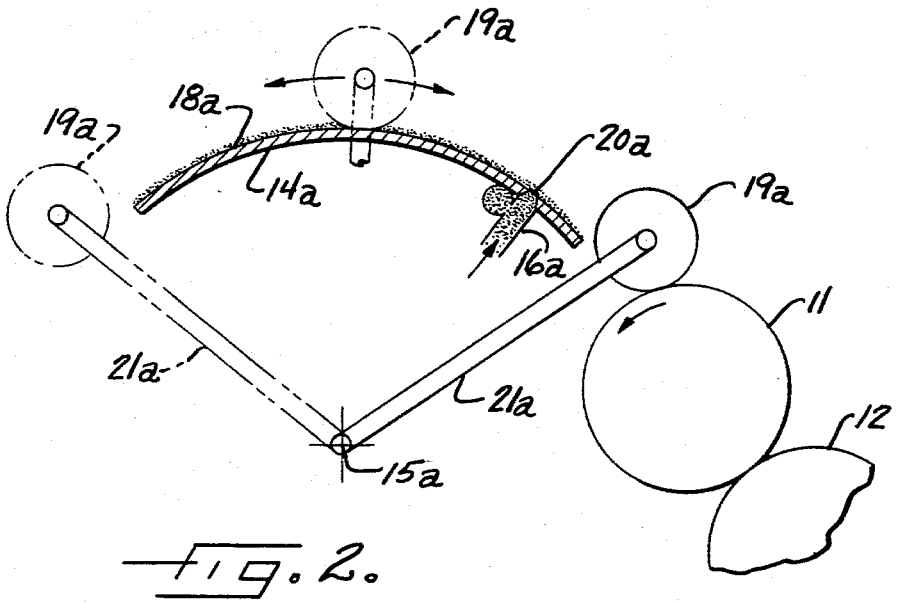
FIG. 2 is a vertical section, illustrated diagramatically, of an alternative ink supply according to the invention.

Referring now to FIG. 2, there is shown an alternative embodiment of an ink supply apparatus according to the present invention, wherein items similar to those discussed above have been given similar reference numerals with the distinguishing suffix "*a*" added. The ink supply apparatus **10*a* includes a curved distributor plate 14*a*, an ink feed 16*a* disposed on the inner side of the curvature for extruding selectively controlled quantities of liquid medium through an aperture or apertures 20*a* onto the outer peripheral surface 18*a* of the distributor plate 14*a*, and a feed roll 19*a* mounted for reciprocating movement along the outer surface 18*a* of the distributor plate 14*a* and into cyclic engagement with the distributor roller 11. In this instance, the feed roller 19*a* is mounted at the end of a guide or vibrator 21*a* which is Pivotably reciprocated about a center point 15*a*. To facilitate uniform spreading of ink along the distributor plate 14*a* without ink buildup at the point of reversal, the vibrator 21*a* preferably pivots to and fro at locations beyond the ends of distributor plate 14*a***, as illustrated.

The ink is fed onto the distributor plate surface **18*a* from the ink feed in timed relation with the reciprocating movement of the vibrator 21*a* and preferably, is fed onto the distributor plate each time the feed roller 19*a* is in contact with the distributor roller 11. This enables the ink to be mixed and applied along the distributor plate twice, since the feed roller 19*a* will engage the ink just after contact with the distributor roller and distribute it over the plate during movement away from the distributor roller, and then will again distribute and spread the ink over the plate upon return movement to the distributor roller. It will be appreciated that such double rolling and distribution of the ink serves to optimize uniform application to the distributor roller 11**.

Figure 3:
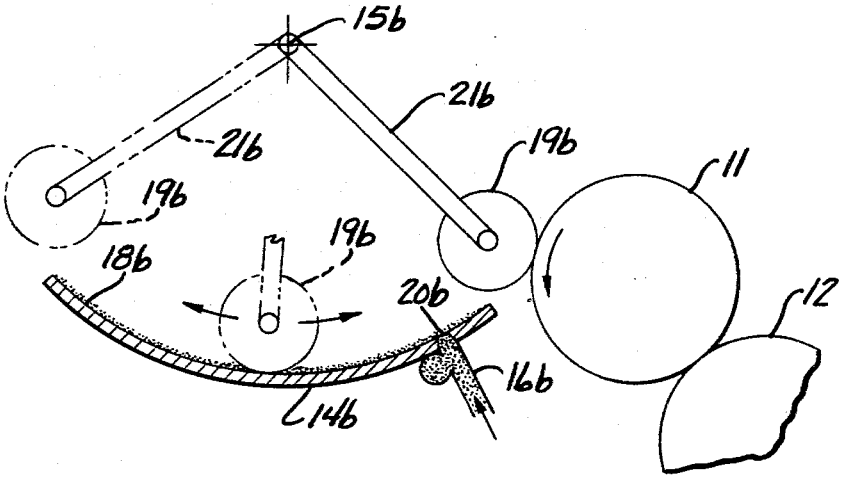
FIG. 3 is vertical section, similar to FIG. 2, but showing still a further alternative embodiment of the present invention.

Referring now to FIG. 3, there is shown still another embodiment of an ink supply apparatus wherein items similar to those discussed above have been given similar reference numerals with the distinguishing suffix "b" added. The ink supply apparatus **10*b* is similar to the apparatus 10*a* shown in FIG. 2, with the exception that the feed roller 19*b* rolls on an inside surface 18*b* of the curved distributor plate 14*b* and the ink feed 16*b* is disposed on the outer curvature of the plate and dispenses the medium through the aperture or apertures 20*b* to the inside of the plate. The vibrator or guide 21*b* as in the case of the embodiment of FIG. 2, again preferably is reciprocated so that the feed roller 19*b*** swings beyond the ends of the distributor plate.

Figure 4:
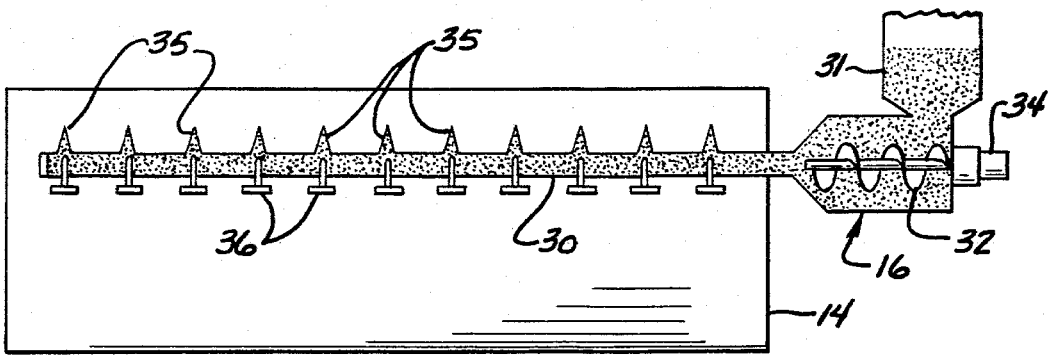
FIG. 4 is a partially diagramatic illustration of one form of ink feed for the distributor plate of the systems shown in FIGS. 1–3.

In keeping with the invention, the ink feed 16 is adapted to quickly and easily quantitively control the feed of liquid medium to the distributor plate 14 between zero delivery and progressively greater amounts. The ink feed 16, as illustrated in FIG. 4, includes a continuous tube 30 extending transversely across the end of the distributor plate 14. The tube 30 is connected at one end to an ink resevoir 31 and ink is directed into the tube by an auger 32 driven by a motor 34. For permitting a transverse-zone controlled distribution of the ink onto the distributor plate 14, the tube 30 includes a plurality of longitudinally spaced nozzles 35. The nozzles may be of a known type, each being individually controlled by a valve member 36. Hence, by adjusting the position of the valve members 36, either manually or by appropriate automatic means, the nozzles 35 can be individually controlled for zero ink delivery or such greater amounts as desired. Such adjustment may be made quickly and easily as the need arises.

Figure 5:
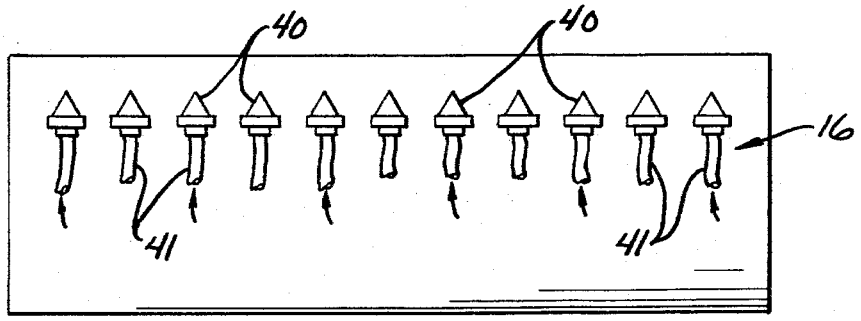
FIG. 5 is a partially diagramatical illustration of another form of ink feed for the distributor plates of the systems shown in FIGS. 1–3.
Figure 6:
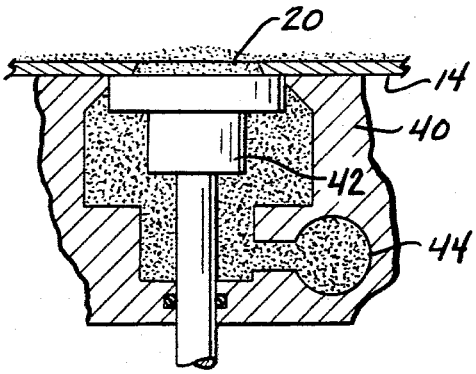
FIG. 6 is an enlarged fragmentary section one form of control valve for the ink feed shown in FIG. 5.

With reference to FIGS. 5 and 6, there is shown an alternative ink feed 16, which is similar to that shown in FIG. 4, except that the liquid medium is feed to selectively controlled valves 40 by individual feed hoses 41. It will be understood that this form of ink feed is particularly adaptable for feeding different colored liquid mediums to zone areas. For controlling the flow of ink through such nozzles 40, each nozzle has a valve number 42 disposed for movement between a position, such as shown in FIG. 6, in which the valve member 42 completely closes a respective supply aperture 20 in the distributor plate 14 and selectively raised positions that permit progressively greater amounts of ink to pass through the aperture 20 from a feed chamber 41. The valves 42 perferably are electronically controlled, utilizing simple digital signals which are dependant upon the speed of the machine.

Figure 7:
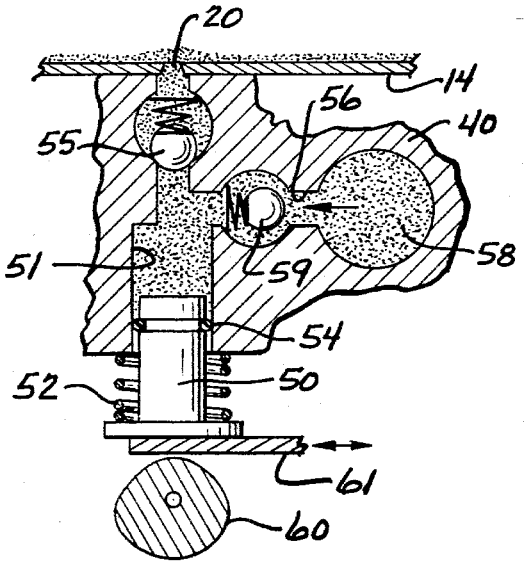
FIG. 7 is an enlarged fragmentary section of an alternative form of control valve for the ink feed shown in FIG. 5.

An alternative form of control for the nozzles 40 is illustrated in FIG. 7. In this embodiment, a piston rod 50 is mounted for reciprocating movement in a fluid chamber 51 and is outwardly biased by a spring 52. The inner end of the piston rod 50 extends into the fluid chamber 51 and is sealed by an o-ring 54. The fluid chamber 51 communicates with the respective aperture 20 in the distributor plate 14 through a check valve 55. A port 56 similarly communicates between a liquid resevoir 58 and the chamber 51 via a second check valve 59. For controlling the operation of the piston rod 50, a cam 60 is rotatably disposed immediately below the piston rod, as viewed in FIG. 7, and a transversely movable cam plate 61 is interposed between the end of the outer piston rod 50 and the cam 60. With the cam plate 61 in the extended position, as shown in FIG. 7, rotational movement of the cam 60 will engage the plate 61, forcing the plate and piston rod in an upward direction, which in turn pressurizes the liquid in the chamber 51, causing the check valve 59 to close the liquid supply part from the reservoir 58 and the check valve 55 to open the chamber 51 to the plate aperture 20, thereby permitting the feed of a controlled amount of liquid onto the distributor plate 14. By virtue of the configuration of the cam, the plate 61 and piston rod 50 are cyclically moved, and the liquid cyclically feed onto the plate. In the event it is desired to interrupt the feed of liquid, the plate 61 may be withdrawn to the right, as viewed in FIG. 7, such that the cam 60 no longer transmits movement to the piston rod. It will be appreciated that the quantity of ink supplied to the distributor plate 14 may be varied by varying both the speed of the cam 60, as well as by positioning of the cam plate 61. Hence, the nozzles may be individually controlled so as to permit relatively precise feeding of liquid onto the distributor plate.

From the foregoing, it can be seen that the ink supply method and apparatus of the present invention is adapted for dispensing ink to distributor and transfer rollers of printing machines and the like with improved control and uniformity, even under minimum ink feed conditions. Moreover, the ink is dispensed from an ink supply to the distributor roller without the necessity of controlling sensitive ink metering gaps. The ink supply, therefore, is not hindered by foreign matter, as in conventional systems, nor is there the need for relatively expensive gap adjusting mechanisms. The ink supply also is independant of thermal variations, and there are no gap-forming parts to wear out or become abraided. Hence, the ink supply enables minimum quantities of ink to be uniformly dispensed on repetative printing work with relatively precise monitoring.

I claim as my invention:

1. An apparatus for supplying a liquid medium to a roller of a machine comprising an arcuate shaped distributor plate having a determined center of curvature, means for feeding a controlled quantity of said liquid medium onto said distributor plate, a feed roller, a guide rotatably supporting said feed roller, means rotatably supporting said guide for movement about the center of curvature of said distributor plate, and means for cyclically moving said guide in a path whereby said feed roller on said distributor plate to mix and uniformly spread the medium along the plate and about the periphery of said feed roller and then is moved into contact with said machine roller to transfer liquid medium thereto in a controlled manner, a smoothing roller rotatably mounted on said guide for constant rotational contact with said feed roller as it is rolled in contact with said distributor plate, and said smoothing roller having a diameter less then the diameter of said feed roller so as not to contact said distributor plate during cyclic rolling movement of said feed roller along said distributor plate.

2. The apparatus of claim 1 in which said distributor plate is formed with at least one feed aperture, and said medium feed means is disposed on one side of said plate for dispensing said liquid medium through said aperture and onto the other side of said distributor plate for mixing and spreading by said feed roller.

3. The apparatus of claim 1 including feed control means for controlling the feed of medium onto said distributor plate in timed sequence with the cyclic movement of said feed roller.

4. The apparatus of claim 1 in which the distributor plate spans a distance corresponding to at least about one-third the circumference of a circle defined by the radius of curvature of said distributor plate.

5. The apparatus of claim 4 in which said guide moving means causes said feed roller to be moved in a circular path whereby said feed roller is cyclically rolled along a length of said distributor plate and then moved into contact with said machine roller.

6. The apparatus of claim 5 in which said machine roller is disposed adjacent one end of said distributor plate and said liquid medium feeding means is disposed adjacent the other end of the distributor plate.

7. The apparatus of claim 4 in which said guide supporting means supports said guide for pivotable movement so that said feed roller is cyclically rolled back and forth on said distributor plate and then moved into contact with said machine roller.

8. The apparatus of claim 7 in which said machine roller is disposed adjacent one end of said distributor plate and said liquid medium dispensing means is disposed at a point adjacent the same end.

9. The apparatus of claim 7 in which said guide moving means causes said feed roller to be moved back and forth on said distributor plate with points of reversal beyond the ends of the said distributor plate.

10. The apparatus of claim 1 in which the guide moving means causes said feed roller to be moved on an inside surface of said arcuate distributor plate.

11. The apparatus of claim 3 in which said liquid medium feeding means includes a plurality of selectively controllable discharge means disposed in transversely spaced relation across a distributor plate, and said nozzles each being coupled to a common liquid medium supply line.

12. The apparatus of claim 3 in which said liquid medium feed means includes a plurality of selectively adjustable discharge means disposed in transversely spaced relation across the distributor plate, said valves each being coupled to a respective liquid medium supply line.

* * * * *